United States Patent [19]

Kucher et al.

[11] Patent Number: 4,640,384

[45] Date of Patent: Feb. 3, 1987

[54] EMERGENCY EVACUATION SYSTEM FOR HIGH-RISE BUILDINGS

[76] Inventors: Alexander Kucher, 1525 Nelson Ave., Manhattan Beach, Calif. 90266; Igor Krasnov, 2587 Captains Ave., Port Hueneme, Calif. 93041; Yury Bromberg, 21802 Fairlane Circle, Huntington Beach, Calif. 92646

[21] Appl. No.: 849,120

[22] Filed: Apr. 7, 1986

[51] Int. Cl.[4] ..... B66B 9/00; A62B 1/02

[52] U.S. Cl. ..... 182/51; 182/63; 182/142; 187/6

[58] Field of Search ..... 182/142, 82, 143, 144, 182/145, 51, 63; 187/6

[56] References Cited

U.S. PATENT DOCUMENTS

| | | | |
|---|---|---|---|
| 1,027,724 | 5/1912 | Harrey | 182/142 |
| 3,945,469 | 3/1976 | Dorcich | 182/142 |
| 4,018,306 | 4/1977 | Lyons | 187/6 |
| 4,042,066 | 8/1977 | Noone | 187/6 |
| 4,121,693 | 10/1978 | Fry | 182/131 |
| 4,122,917 | 10/1978 | Kendricks | 182/10 |
| 4,246,199 | 3/1981 | Sellards | 182/11 |
| 4,355,699 | 10/1982 | Smith | 182/142 |
| 4,386,680 | 6/1983 | Reed | 182/142 |
| 4,406,351 | 9/1983 | Littlejohn | 182/51 |
| 4,469,198 | 9/1984 | Crump | 182/82 |
| 4,569,418 | 2/1986 | Novarini | 182/63 |

*Primary Examiner*—Reinaldo P. Machado
*Attorney, Agent, or Firm*—Bruce L. Birchard

[57] ABSTRACT

An emergency evacuation system for a high-rise building includes a cable carried on a spool positioned on the top of the building, such cable having at its end remote from the spool a weighted coupler dimensioned to be received by a powered spool carried within an escape cabin, such escape cabin having an entry-exit side and crawler means supported on that entry-exit side for engaging the building to permit smooth raising and lowering of the cabin.

10 Claims, 6 Drawing Figures

EMERGENCY EVACUATION SYSTEM FOR HIGH-RISE BUILDINGS

BACKGROUND OF THE INVENTION

1. Field of the Invention

This invention relates to emergency evacuation systems and more particularly to such systems as applied to high-rise buildings, particularly as used in connection with fire emergencies in such buildings.

2. Prior Art

A search of the prior art in the Patent Office revealed the following patents, which are related to but do not anticipate our invention.

U.S. Pat. No. 4,018,306 (Lyons) issue date Apr. 19, 1977.

U.S. Pat. No. 4,256,199 (Sellards) issue date Mar. 17, 1981.

U.S. Pat. No. 4,121,693 (Fry) issue date Oct. 24, 1978.

U.S. Pat. No. 4,122,917 (Kendrick) issue date Oct. 30, 1978.

U.S. Pat. No. 4,018,306 (Lyons) discloses a plurality of vertical railroads attached to the side of the building. Mobile units are installed on the vertical railroads on a safe side of the building. The mobile units are raised and lowered on the vertical railroad tracks by means of hoist ropes and a climbing hoist. Such installations would be incredibly expensive because of their permanent nature. As a result of that economic fact and the fact that architecturally the buildings would be very unattractive with railroad tracks running up and down the sides of the buildings, the system of the Lyons patent has no practical significance.

U.S. Pat. No. 4,256,199 (Sellards) shows a rescue system in which a self-powered trolley is moved along a tensioned cable connected between the top of the building and some fixed object spaced from the building, for example a fire plug. The problem with this system is that, at the lower floors of the building, the cable is spaced especially far from the building so that is not possible to properly communicate between the building and the platform which rides up and down the tensioned cable.

U.S. Pat. No. 4,121,693 (Fry) fails to show a structure which is completely stable, in that the cabin for removing persons from the building being evacuated is supported only by the chain or cable which it is adapted to self-climb. Also, there is a problem of the space between the rescue cabin and the building, which space makes it difficult for a party wishing to escape the building to bridge the gap between the cabin and the building.

U.S. Pat. No. 4,122,917 (Kendrick) discloses a rescue system in which the rescue cabin or basket is raised and lowered by means of a cable with a second cable being provided in the form of a tie-line to guide the basket away from and toward the building, the cable being tensioned at the bottom and by being pulled away from the building by truck to which the cable is attached at its lower end. Once again there is the problem of stable spacing between the rescue cabin and the building from which the evacuation is occurring. With the system of the Kendrick patent it would be difficult to align the rescue cabin with the escape opening in the building and with a practical spacing of the cabin from the building.

Therefore it is an object of this invention to provide for a high-rise building an emergency evacuation system which is free of the various problems and limitations recited hereinbefore.

It is a further object of this invention to provide a system for the safe and reliable evacuation of people from a high-rise building in which system the escape cabin is stable during its raising and lowering process and is proximate to the building from which the evacuation is being effected.

It is a still additional object of this invention to provide an evacuation system for high-rise building in which system the escape cabin may be accurately positioned with respect to the escape opening in the high-rise building from which the evacuation is being effected.

SUMMARY OF THE INVENTION

The emergency evacuation system according to this invention includes a spool of wire cable permanently mounted on the top of the high-rise building and overhanging the wall of the building approximately three feet. The spool is aligned with the openings in the buildings from which escape is expected to be effected. The spool is normally braked to prevent its rotation. The brake is released when the fire or smoke alarm system in the building indicates that such release is appropriate. Parallel controls may be provided on the outside of the building to release the brake.

When the brake is released the spool of cable unwinds by reason of the fact that there is attached to the end of the wire cable remote from the spool a weight which causes the spool to rotate when the brake is released and the weight is shaped to couple quickly to a winch or powered spool in the escape cabin which is brought to the scene of the emergency by a trailer attached to, for example, a fire engine. The winch or powered spool in the cabin is controlled from a control-board within the cabin or, alternatively, from an emergency control on the ground. The door of the cabin faces the building from which the rescue is to be effected and contains an adjustable gangway which can be utilized to connect the cabin with the appropriate window or other opening in the building when the cabin has been aligned with the desired escape opening. On the same side of the cabin as the gangway there is provided a pair of crawlers which are supported from the cabin but which are in contact with the wall of the building in its spaces between windows to act as an anti-swinging device when the cabin is being raised and lowered by its own power. The crawlers distribute the cabin weight over the wall of the building and prevent breaking of windows. The crawlers assure stability of the cabin as it self-propels itself up and down along the cable which has been dropped from the spool on the top of the building. A plurality of spools and cables may be provided around the building and an equal plurality of escape cabins is then provided by way of the trailers brought to the scene by the emergency vehicles. Electrical cables and water-carrying hoses of a fire-resistant nature extend from the trailer unit which brought the cabin to the scene to the cabin as the cabin propels itself up and down the cable depending from the spool on the roof. The caterpillar-like crawler elements assure stability of the escape cabin and proper spacing of the escape cabin from the outer wall or face of the building so that the people trapped in the building may easily utilize the escape gangway of the cabin to escape from the building being evacuated.

BRIEF DESCRIPTION OF THE DRAWINGS

Those and other features of our invention will be best understood from the description which follows taken in connection with the accompanying drawings, in which:

FIG. 4(*a*) shows an improvement in the permanently installed portion of the evacuation system shown in FIG. 4; and, FIG. 5 is a mechanical schematic diagram of the emergency high-rise evacuation system, according to our invention, in use.

DETAILED DESCRIPTION OF THE PREFERRED EMBODIMENT

Figure 1:
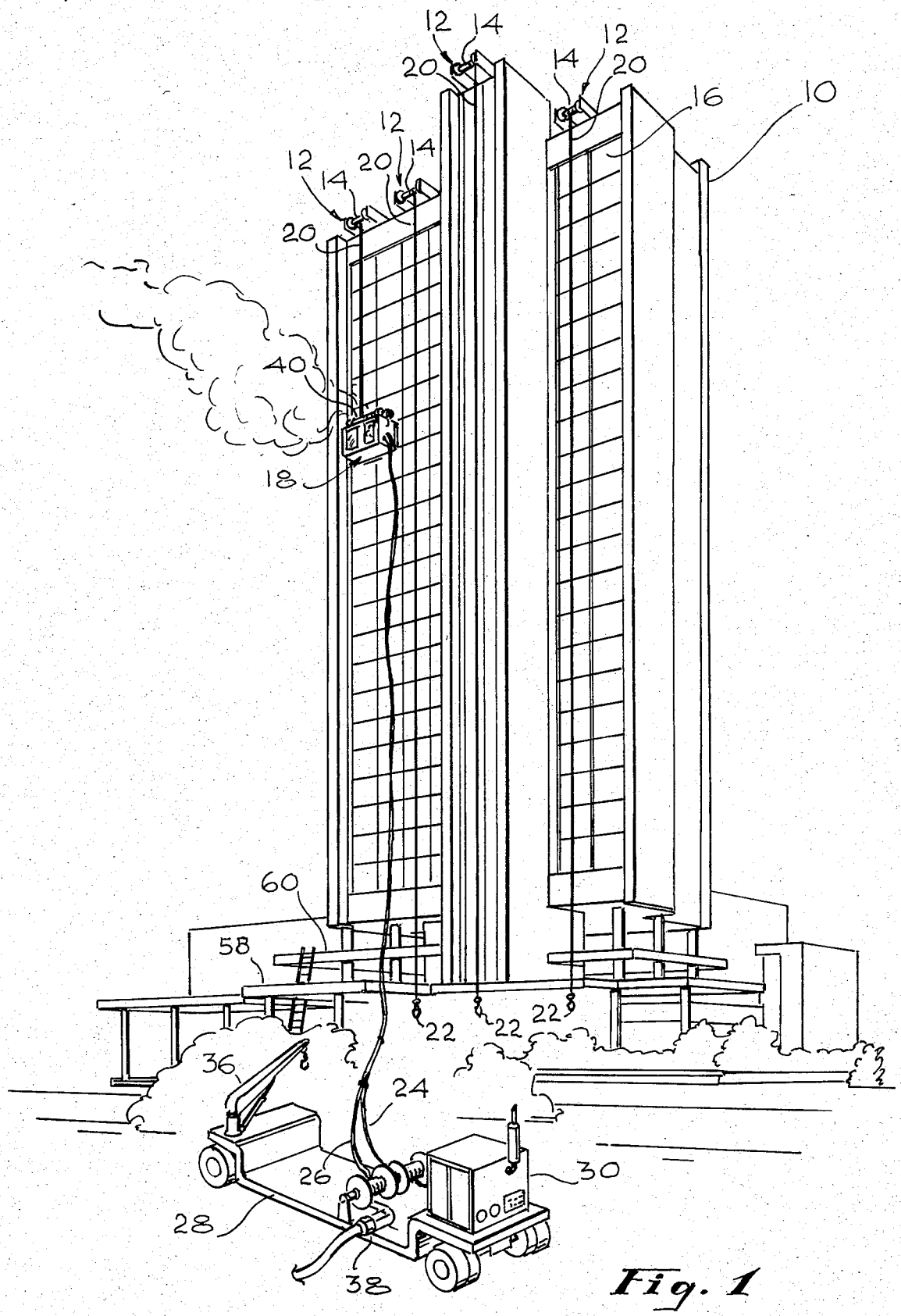
FIG. 1 is a perspective view of an emergency evacuation system for high-rise buildings, according to our invention, with a portion of the system enlarged.

In FIG. 1, building 10 has a plurality of fixed installations 12 of wire cable spools 14 mounted so as to extend beyond the face 16 of building 10, the distance of extension being such that the escape cabins 18 are spaced, when rising and falling, about three feet from the face 16 of building 10. The details of the permanently installed fixed installation 12 can be seen more clearly in FIGS. 4 and 4(*a*). The fixed installations 12 are positioned so that they are directly above a column of windows or other escape openings in the front surface 16 of building 10. Cables or wire ropes 20 are carried on spools 14 and each has at its end remote from spools 14 a combination weight and coupler 22 which can be seen more clearly in FIGS. 4 and 4(*a*).

Electrical power and water under pressure are provided to the evacuation cabin 18 by way of electrical cable 24 and hose 26, respectively. While, in FIG. 1, a single evacuation cabin 18 is shown in use, it is to be understood that multiple cabins may be provided. Reference to FIG. 5 shows a trailer that carries two evacuation cabins. There must, of course, be provided electrical cables and hoses with water under pressure for each of the evacuation cabins. As may be seen in FIGS. 4 and 4(*a*), spools 14 are normally restrained from rotating by means of a brake 68 which is normally on. When that brake 68 is released in response to a signal from a fire or smoke sensor in the building or in response to a signal from the building that the power has been lost in the building, weight-couplers 22, by reason of their weight, will cause spools 14 to rotate, releasing cables 20 which will be extended their full length at which permit the couplers 22 will be about eight feet above ground level for easy attachment to evacuation cabin or cabins 18 which has been delivered to the site by fire department or other emergency vehicles using trailers of the type of trailer 28. Trailer 28 carries a spool of fire-resistant electrical cable 24, the hose 26 for water under pressure and a 10-HP diesel-to-electrical power station. The details of trailer 28 may be seen more clearly in FIG. 2.

Figure 2:
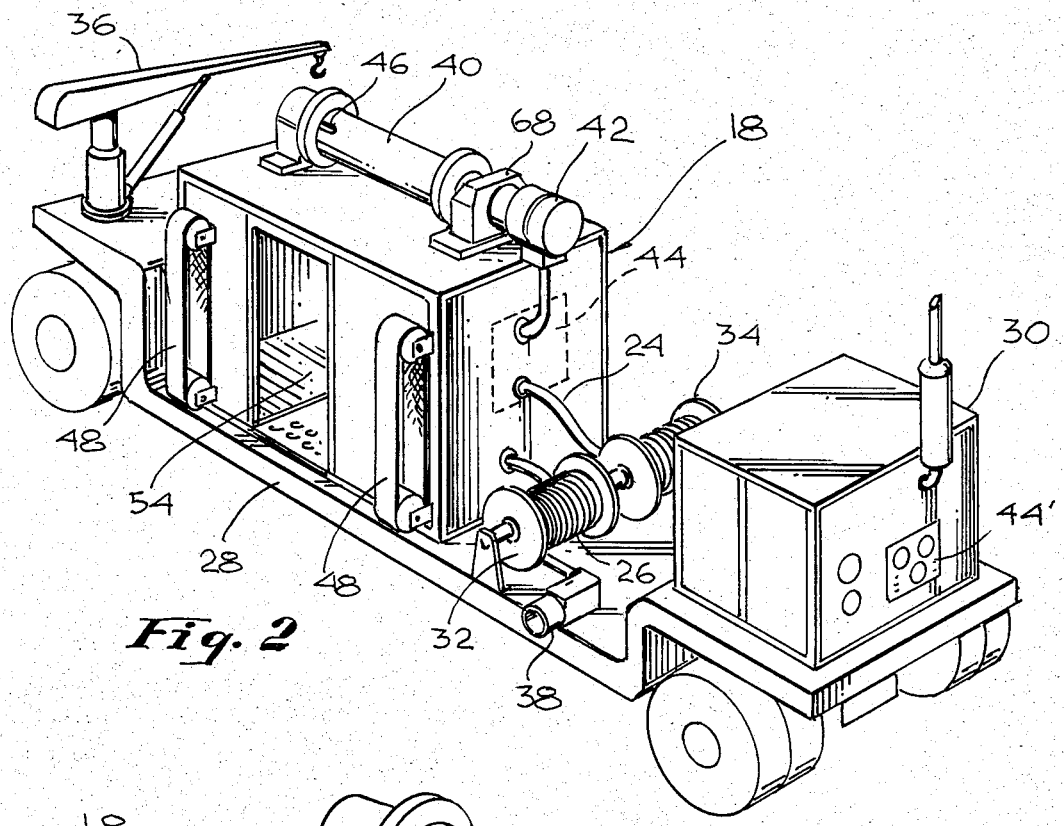
FIG. 2 is a perspective view of a first portion of the evacuation system, according to our invention.
Figure 3:
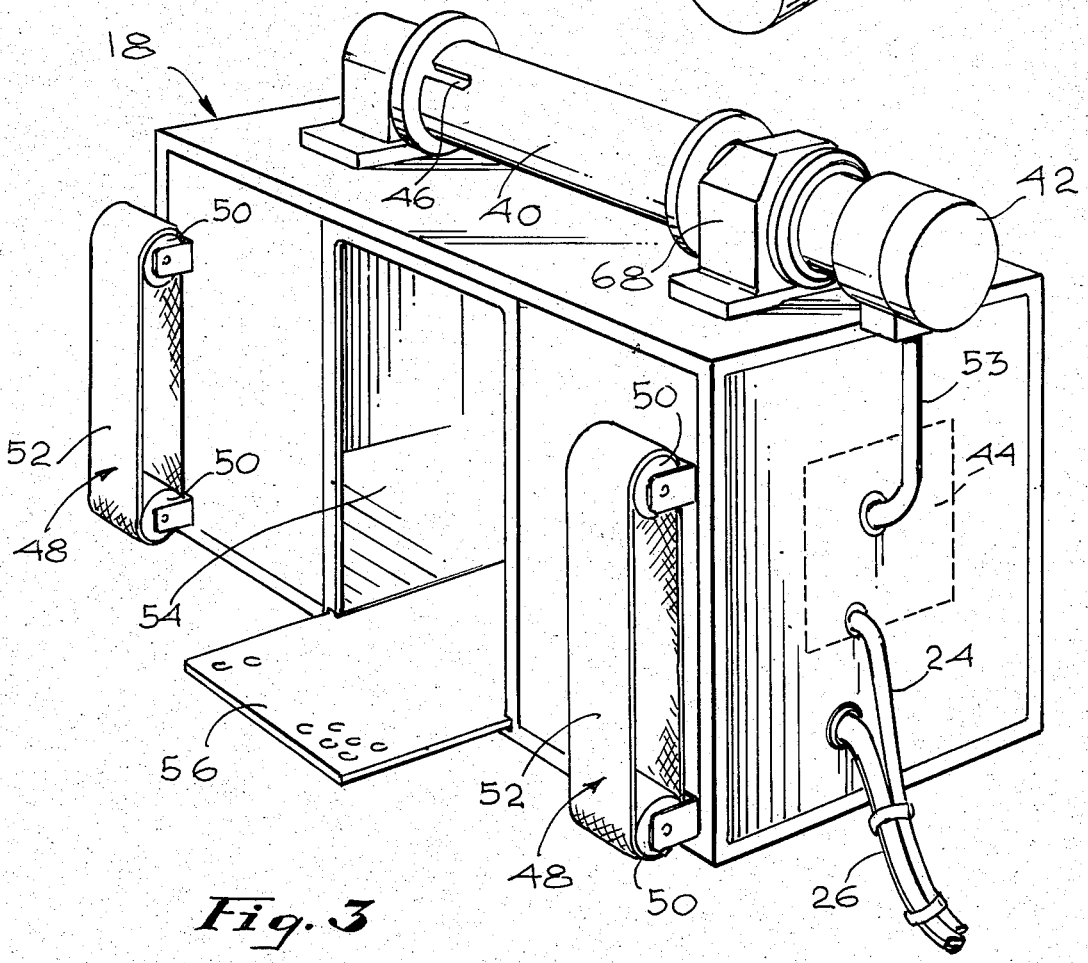
FIG. 3 is a perspective view of a second portion of the emergency evacuation system, according to our invention.

In FIG. 2, trailer 28 carries thereon the escape cabin 18 and the electrical power generator 30 as well as a pair of reels 32 and 34 which, respectively, provide water under pressure and electrical power to escape cabin 18, by way of hose 26 and electrical cable 24, respectively. Trailer 28 has a winch 36 which is used to load cabin 18 onto trailer 18. Water under pressure from a hydrant or pump is supplied to hose 26 by way of coupler 38. Cabin 18 is provided with a power-driven spool 40 which receives its rotational power from an electrical motor 42 controlled either by panel 44 or, remotely, from trailer 28 which means on the ground. Spool 40 has an easy-access coupling slot 46 into which mechanical couplers 22 may be placed easily for self propulsion of cabin 18 up cables 20. Cabin 18 also carries caterpillar-tractor-like crawlers 48 which maintain cabin 18 stably against the face 16 of building 10 during the raising and lowering of cabin 18. In this case, crawlers 48 are not directly driven but are caused to move about their guide-drums 50 by the frictional contact between crawlers 48 and the face 16 of building 10. Reference should be made to FIG. 3 for more details.

In FIG. 3, cabin 18, in addition to having crawlers 48 with tracks 52 moving about drums 50 has an opening 54 and a gangway portion 56 which is extendable from cabin 18 towards the opening in the building, which opening is to be used for evacuation of the trapped personnel. Extension of gangway 56 makes it easy for the people to be evacuated from the building 10 into the cabin 18.

Motor 42 is provided to power spool 40 after a cable coupler 22 has been connected into slot 46. Power for operation of motor 42 comes by way of electrical cable 24 from the motor-generator set 30 on trailer 28. The electrical power passes by way of control panel 44 and cable section 52. Provision may be made to effect control of motor 42 from trailer 28. It should be understood that drums 50 are freely rotatable and are caused to rotate by the frictional contact between belts 52 and face 16 of building 10.

Purely by way of example, the cabin 18 may carry two fire fighters and their equipment. The ascent of the cabin 18 may be controlled by one of the fire fighters. As soon as cabin 18 is stopped opposite the desired opening in face 16 of building 10, gangway 56 may be extended. Gangway 56 may have handrails to assist the evacuees in entering cabin 18. After the evacuees have been loaded into cabin 18 it descends. Should building 10 have a stepped configuration, the stepped portion usually is at the lower part of the building and, in that event, cabin 18 should be raised above these extensions (such as extensions 56 and 60 in FIG. 1) by way of standard mechanical extension ladders normally carried by fire engines.

Cabin 18 may be made from light-weight, fire-retardant material. Cabin 18 in insulated and is equipped with emergency oxygen equipment, a couch, fire extinguishing equipment and a ventilation system, not shown. It is to be understood that doorway 54 of cabin 18 faces the outer face 16 of building 10. Crawlers 48 distribute the lateral weight of cabin 16 over the wall of the building thus preventing an overload on glass windows or the like which may traversed by cabin 18 as it ascends and descends.

Figure 4:
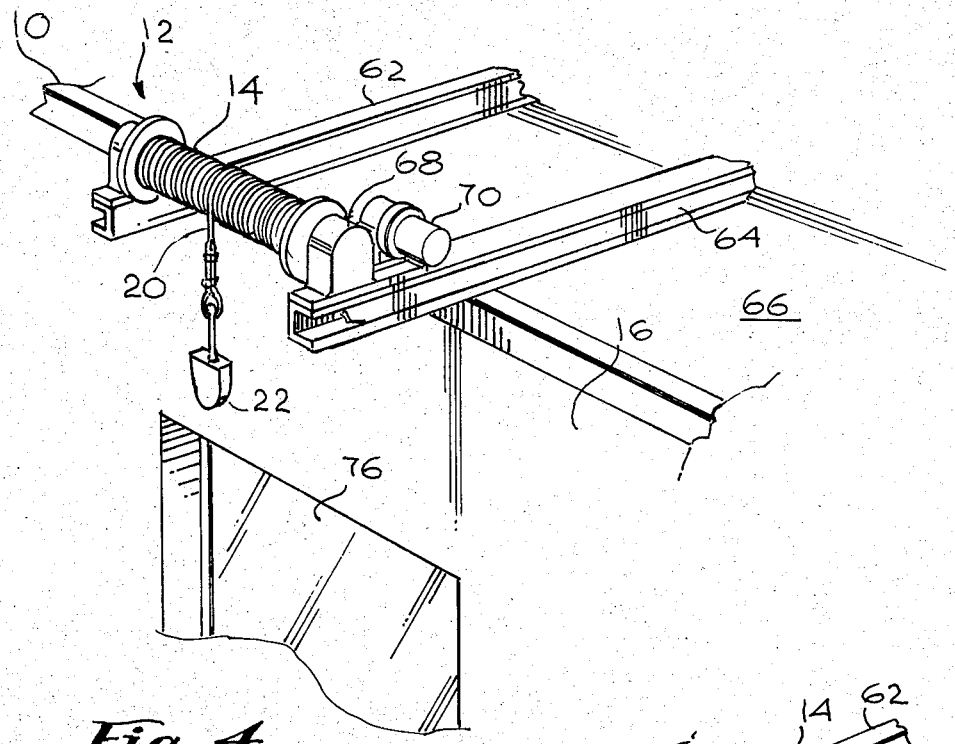
FIG. 4 is a perspective view of the permanently installed portion of the high-rise evacuation system, according to our invention.
Figure 4A:
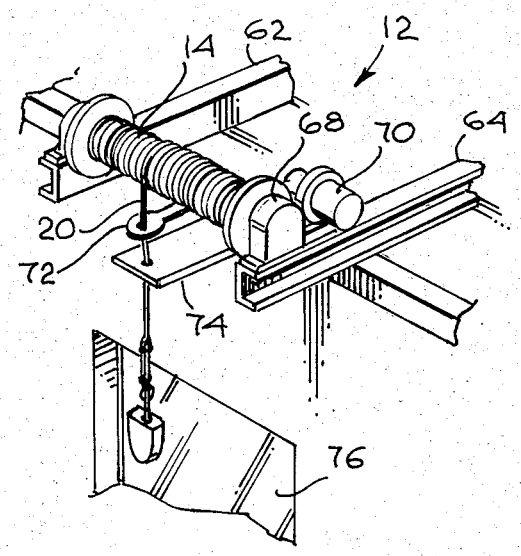
Figure 5:
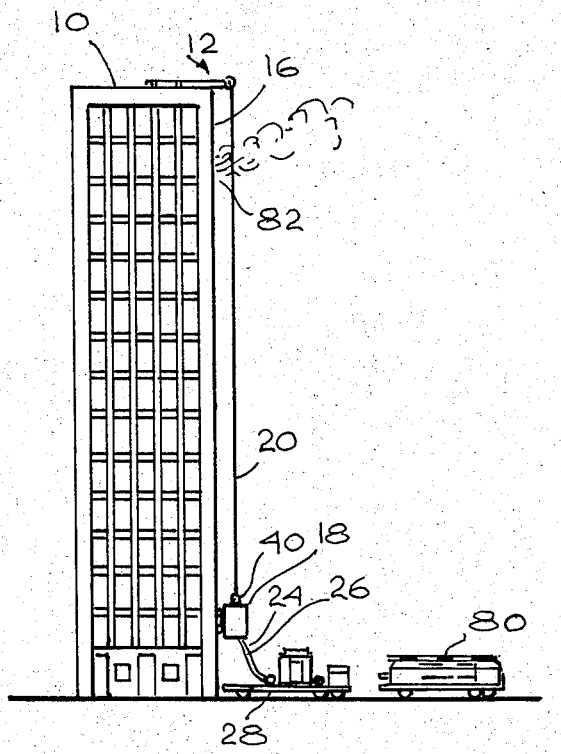

Turning to FIGS. 4 and 4(*a*), beams 62 and 64 are firmly secured to roof 66 of building 10 and extend beyond face 16 of building 10 about seven feet. This permits cable 20 to fall about six feet in front of face 16 of building 10. Cable wire rope 20 has a weight capacity of approximately 10,000 pounds and is long enough to be lowered to within eight feet of the ground. Weight-coupler 22 has a weight of sufficient magnitude to cause spool 14 to be rotated by its weight when brake 68 is released. Brake 68 is normally in an "ON" condition so as to prevent the falling of weight-coupler 22 by reason of uncontrolled rotation of spool 14. As has been indicated, brake 68 is released by reason of a signal from a fire or smoke alarm within building 10 or it may be released manually by a control on the outside of building 10 at ground level. Motor 70 is coupled to spool 14 and permits rewinding of cable 20 after the emergency has past. It receives its electrical power from inside building 10 thru cables, not shown. To assure alignment of cable 20 with the center of the openings intended to be used for evacuating persons from the building and to further prevent entangling of the cable as it is rewound or payed out, mechanical means such as those shown in FIG. 4(*a*) may be provided. In FIG. 4(*a*), treadle elements 72 assures that cable 20 is wound evenly over the surface of spool 14. Treadle element 72 oscillates as cable 20 is payed out or rewound, thus distributing cable 20 evenly over the surface of spool 14. Guide 74, which does not move, may be provided to align, throughout the operation of the evacuation system, cable 20 with the center of windows 76, for example. Thus the lateral position of cabin 18 in front of the openings thru which escape is to be effected, is assured. As has been described, crawlers 48 have rubber belts 52 which, additionally, prevent lateral displacement of cabin 18 with respect to the front face 16 of building 10 so as to assure alignment of doorway 54 with the openings thru which persons are to be evacuated. It should be understood that in place of oscillating treadle 72 the entire spool may be oscillated back and forth to assure even layering of cable 20 on spool 14. In FIG. 5, trailer 28 has been moved into position by a fire engine or other emergency vehicle 80, cable 20 has been coupled to powered spool 40 by way of coupling slot 46 and cabin 18 is in the process of raising itself by way of powered spool 40 to the desired region of front face 16 of building 10 so as to permit evacuation of personnel from the fire endangered region 82. Power and water are provided by way of cable 24 and hose 26, as described previously. As can be seen from FIG. 5, trailer 28, in this case, carries two cabins and after the first one has been launched the second one may be moved into position for launching.

While a particular embodiment of our invention has been shown and described, it will be apparent to those skilled in the art that variations and modifications may be made therein without departing from the spirit and scope of our invention. It is the purpose of the appended Claims to cover all such variations and modifications.

We claim:

1. An emergency evacuation system for a high-rise building including:

a support structure secured to the top of said building, said support structure including at least one spool rotatably carried in said support structure;

cable means carried by said spool and selectively payable outwardly therefrom and re-windable thereon;

a weight-coupler carried by said cable at the end thereof remote from said spool;

brake means carried by said support structure in cooperative engagement with said spool for normally preventing rotation of said spool, said brake means being releasable;

escape cabin means having a powered spool thereon, said powered spool having a slot therein for receiving, in secure engagement, said weight-coupler;

electromechanical means coupled mechanically to said power spool for powering it in a controlled fashion to cause the rotation of said powered spool and the consequent raising and lowering of said escape cabin;

said escape cabin having an entry-exit side; and, crawler means supported on said entry-exit side of said escape cabin for engaging said building during the raising and lowering of said escape cabin.

2. A system according to claim 1 which includes, in addition, means for supplying water and electrical power to said rescue cabin.

3. A system according to claim 1 in which said entry-exit side includes a doorway and gangway means extendable from said doorway.

4. A system according to claim 1 in which said entry-exit side of said rescue cabin carries a pair of crawlers each having a caterpillar-tractor-like belt.

5. A system according to claim 1 in which said entry-exit side of said rescue cabin includes a doorway having a gangway at the lower extremity thereof and a pair of crawlers supported from said entry-exit side for movable contact with said building.

6. Apparatus according to claim 4 in which said crawlers each includes a belt movable about a pair of rotatable drums.

7. A system according to claim 1 which includes, in addition, a trailer and an electrical power generator carried by said trailer and electrically coupled to said rescue cabin for electrically powering said powered spool.

8. A system according to claim 7 in which said trailer carries, rotatably thereon, a pair of reels, one carrying water hose and the other electrical cable, said electrical cable being coupled, at one end, to said electrical power generator.

9. A system according to claim 7 in which said trailer carries rotatably thereon in a reel, said reel carrying thereon an electrical cable connectable at one end to said electrical power generator and at the other end to said rescue cabin.

10. A system according to claim 9 which includes, in addition, control means for controlling the flow of electricity to said powered spool on said rescue cabin.

* * * * *